United States Patent [19]

Davies

[11] 4,162,804

[45] Jul. 31, 1979

[54] LIFTING CLAMP

[75] Inventor: William Davies, Jacksonville, Fla.

[73] Assignee: J. C. Renfroe and Sons, Inc., Jacksonville, Fla.

[21] Appl. No.: 876,006

[22] Filed: Feb. 8, 1978

[51] Int. Cl.[2] ..... B66C 1/48

[52] U.S. Cl. ..... 294/101; 294/104; 294/106

[58] Field of Search ..... 294/101, 102 R, 103 R, 294/104, 106, 114, 113, DIG. 1; 24/241 PS, 241 SL, 248 R, 248 B

[56] References Cited

U.S. PATENT DOCUMENTS

| | | | |
|---|---|---|---|
| 1,369,807 | 3/1921 | Hench | 294/114 |
| 2,360,602 | 10/1944 | Waldrup | 294/104 |
| 2,370,411 | 2/1945 | Monaco | 294/104 |
| 2,446,610 | 8/1948 | Renfroe | 294/104 |
| 2,654,630 | 10/1953 | Renfroe | 294/104 |
| 2,852,300 | 9/1958 | Gardner | 294/104 |

*Primary Examiner*—Johnny D. Cherry
*Attorney, Agent, or Firm*—Schuyler, Birch, Swindler, McKie & Beckett

[57] ABSTRACT

A lifting clamp for articles such as steel plates has a movable arcuate gripping jaw, a pivotally mounted arcuate cam jaw, an enlarged recessed opening to receive the article to be lifted, a shackle, a linkage connecting the shackle to the gripping jaw and a locking mechanism engageable with the linkage to lock the gripping jaw in either open or closed position. The locking mechanism has a handle located outside of the clamp body, an integral connection between the handle and an interior portion of the locking mechanism and an auxiliary spring biased locking pin for holding the locking mechanism in the closed position.

20 Claims, 11 Drawing Figures

FIG. 6
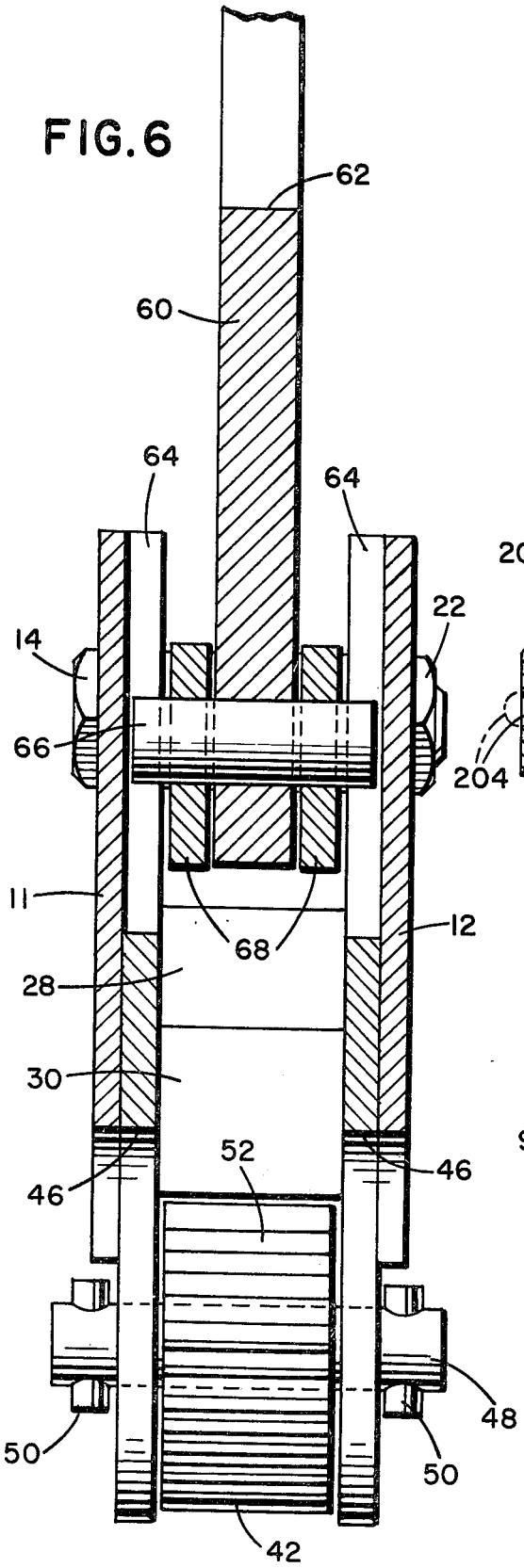
FIG. 7
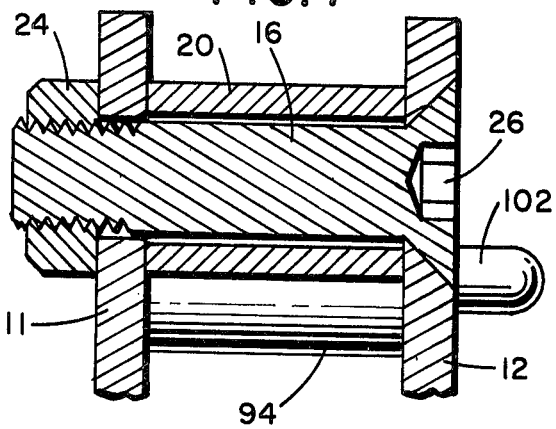
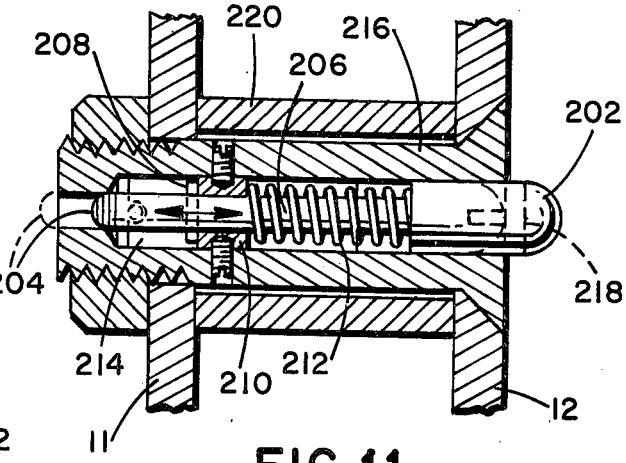
FIG. 11
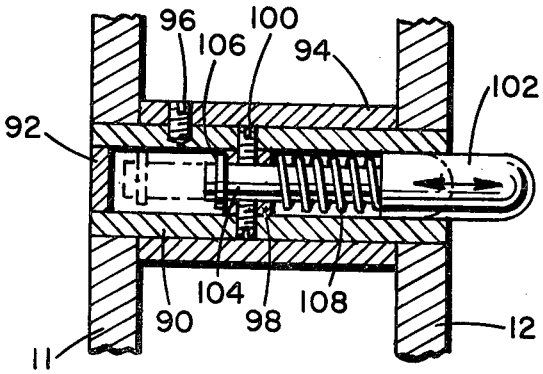
FIG. 8

LIFTING CLAMP

BACKGROUND OF THE INVENTION

1. Field of the Invention

This invention relates to clamps for lifting articles such as steel plates and more particularly to such clamps having a locking device to retain the clamp jaws in either an open or closed position.

2. Description of the Prior Art

U.S. Pat. No. 2,654,630 discloses a clamp, comprising a clamp body having a slot to receive an article to be lifted. A jaw is provided on each side of the slot adjacent the outer open end of the slot. The gripping jaw is movable between open and closed positions relative to the other jaw which is generally fixed. The movable jaw is operated by a shackle connected to the movable jaw by a force multipling linkage.

The clamp body includes a pair of spaced side plates. Mounted on the inside of the side plates is a pivotal locking plate operated by a handle located outside the side plate. A heavy tension spring connects the locking plate to the linkage which extends between the shackle and the movable jaw. By rotation of the locking handle to a closed position, the spring exerts a heavy closing force on the movable jaw. At the same time however, the spring tends to cant the pivot pin connecting the locking plate to the handle to a position inclined relative to its normal axis. This causes a heavy operating action which makes the lever difficult to operate.

It has been found that some clamps tend to permit a plate being lifted to engage a portion of the slot of the clamp in swinging back and forth such that the plate tends to "walk out" of the slot and its engagement with the clamp jaws.

Also in clamps, in their use, there could be a danger of the operating handle striking an object while the steel plate is being lifted which releases the handle to its open position, thus running the danger of the steel plate becoming released from the clamp during the lifting operation.

SUMMARY OF THE INVENTION

Generally, the invention relates to a lifting clamp which comprises a clamp body including a pair of spaced side plates. The body defines a slot through the side plates to receive an article to be lifted, this slot being laterally enlarged inwardly of its open outer end. The pair of opposed jaws which are arcuate in shape are mounted with one jaw on each opposing face of the slot. A shackle is mounted for guided movement in the clamp body and has a lifting connection to apply a lifting force with the shackle being connected by a link to the gripping jaw which is movable between open and closed positions. The opposite clamping jaw is also mounted to be movable for limited pivotal movement.

A locking means having a manually operated handle pivotally mounted on the outside of the clamp body, has a spring tension created by rotation of a handle to urge the gripping jaw to its closed position, and release the spring tension by reverse rotation of the handle to move the gripping jaw to its open position.

The manually operated handle additionally has an auxiliary lock which is manually operated to latch the handle against inadvertent or unintentional movement of the handle from its position urging the gripping jaw to a closed position. This auxiliary lock is spring biased to latch the handle by mere movement of the handle into the position urging the gripping jaw toward closed position. The auxiliary lock is manually depressed to unlatch the handle. Also the auxiliary lock may be constructed to remove it from its normal position for latching the handle when the use of the auxiliary lock is not desired.

A primary object of the present invention is to provide an improved lifting clamp of the general type disclosed in Renfroe U.S. Pat. No. 2,654,630, having an easily operated locking mechanism and a slot enlarged at its inner end remote from the outer open end of the slot to obtain better and safer lifting conditions where the jaws are arcuate and movably mounted on the opposite sides adjacent the open end of the slot.

It is also a principal object of this invention to provide an improved lifting clamp with an easily operated mechanism and an auxiliary lock to latch the primary locking mechanism against inadvertent release.

Another object of this invention is to provide an auxiliary lock to latch the above mentioned locking mechanism which can be deactivated and held deactivated from its normal position where it latches the handle of the primary locking mechanism.

Other advantages of this invention will become apparent from the following disclosure taken in connection with the accompaning drawings wherein preferred construction of embodiments of the invention are set forth by way of example.

BRIEF DESCRIPTION OF THE DRAWINGS

FIG. 6 is a sectional view taken on line 6—6 of FIG. 3.

FIG. 7 is a sectional view taken on line 7—7 of FIG. 2.

FIG. 8 is a sectional view taken on line 8—8 of FIG. 2.

FIG. 11 is a view of a further alternative embodiment for the auxiliary lock to enable it to be deactivated when its use is not desired.

DESCRIPTION OF THE PREFERRED EMBODIMENTS

Figure 1:
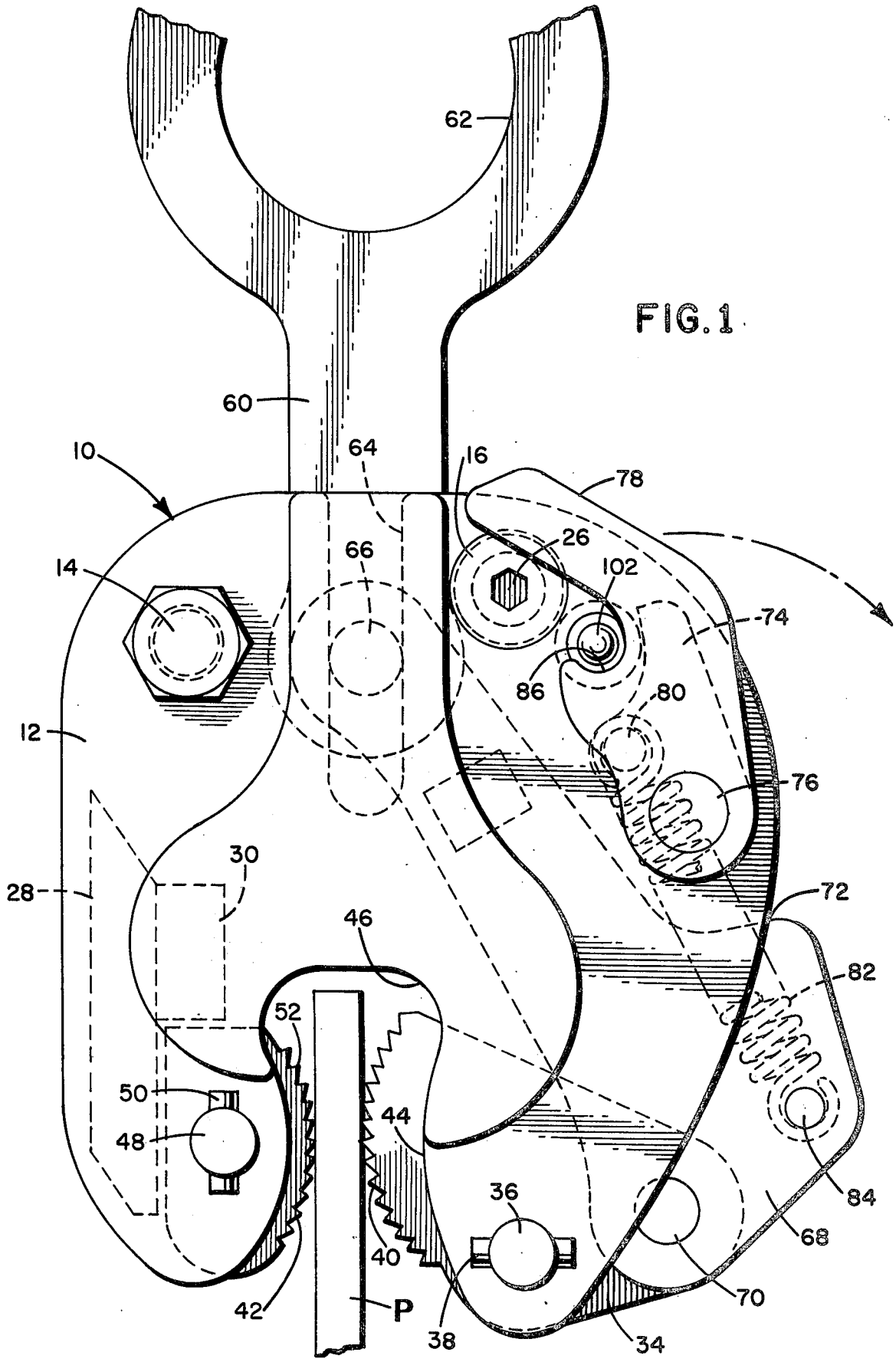
FIG. 1 is an elevational view showing the lifting clamp of the invention from the side carrying the manually operated handle in its latched closed position.
Figure 2:
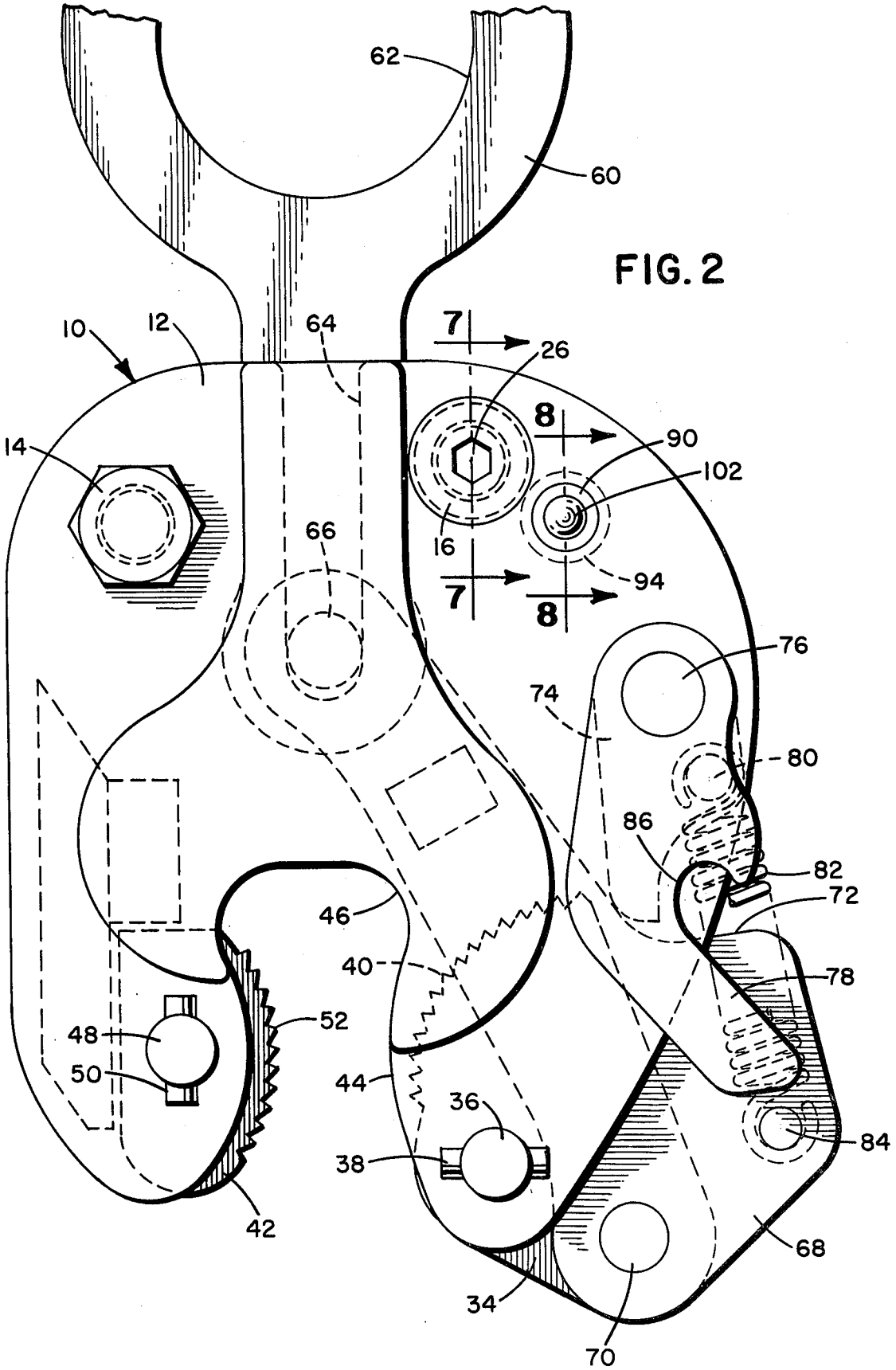
FIG. 2 is a view similar to FIG. 1 but showing the handle released for the gripping jaw to be moved to open position.

As shown in FIG. 1 the clamp 10 has its locking mechanism latched by an auxiliary spring biased locking pin in the position where the jaws of the clamp are urged to hold an article being lifted such as plate P. FIG. 2 shows the clamp 10 with the locking mechanism unlatched from the auxiliary spring biased locking pin and the mechanism moved to the jaw opening position where the two jaws of the clamp are moved apart from the clamp to be ready to receive an article to be lifted.

Figure 3:
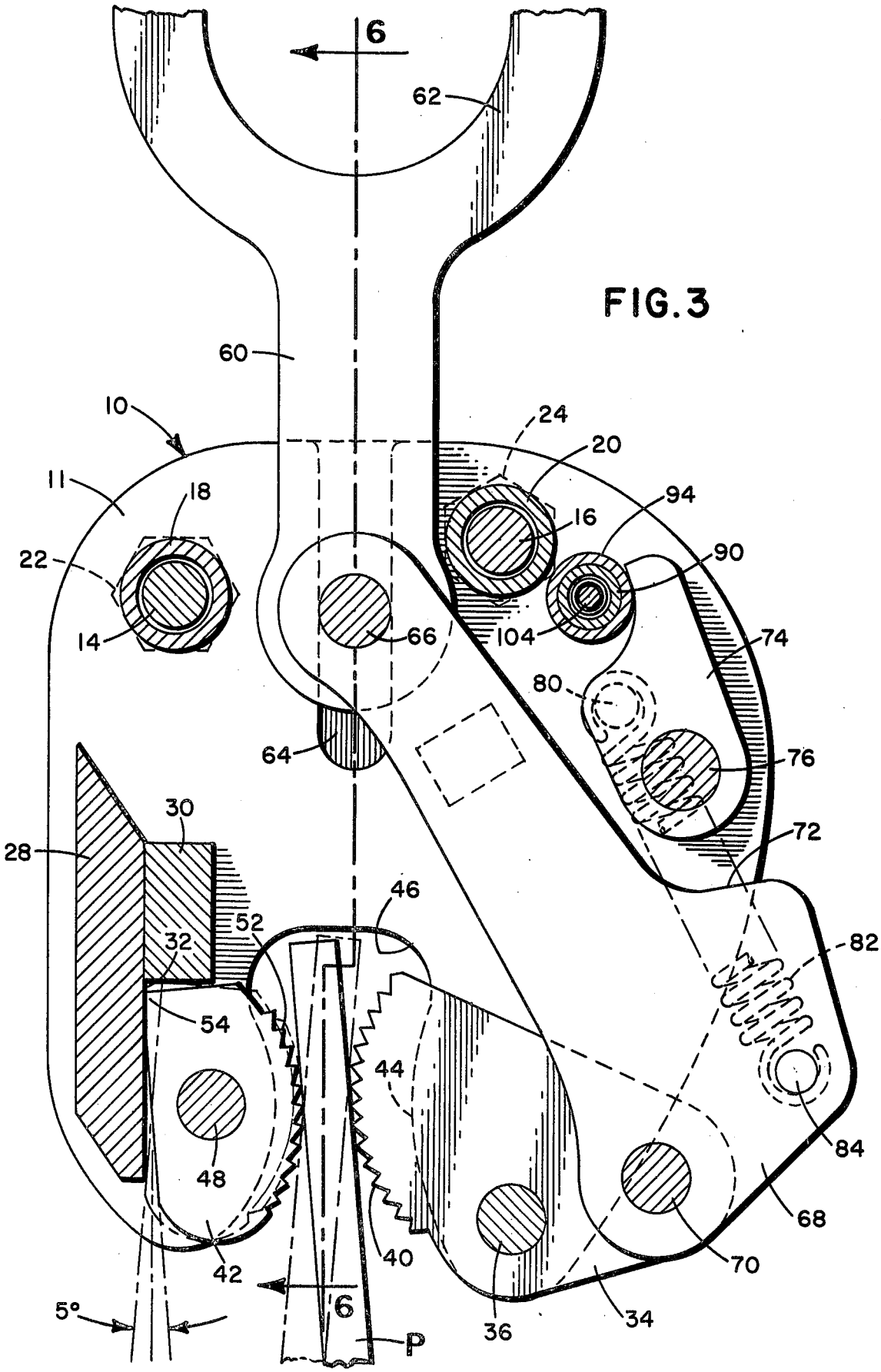
FIG. 3 is a sectional view taken on line 3—3 of FIG. 4, showing how the movable arcuate jaws and laterally enlarged slot permit a plate being lifted to swing back and forth.
Figure 4:
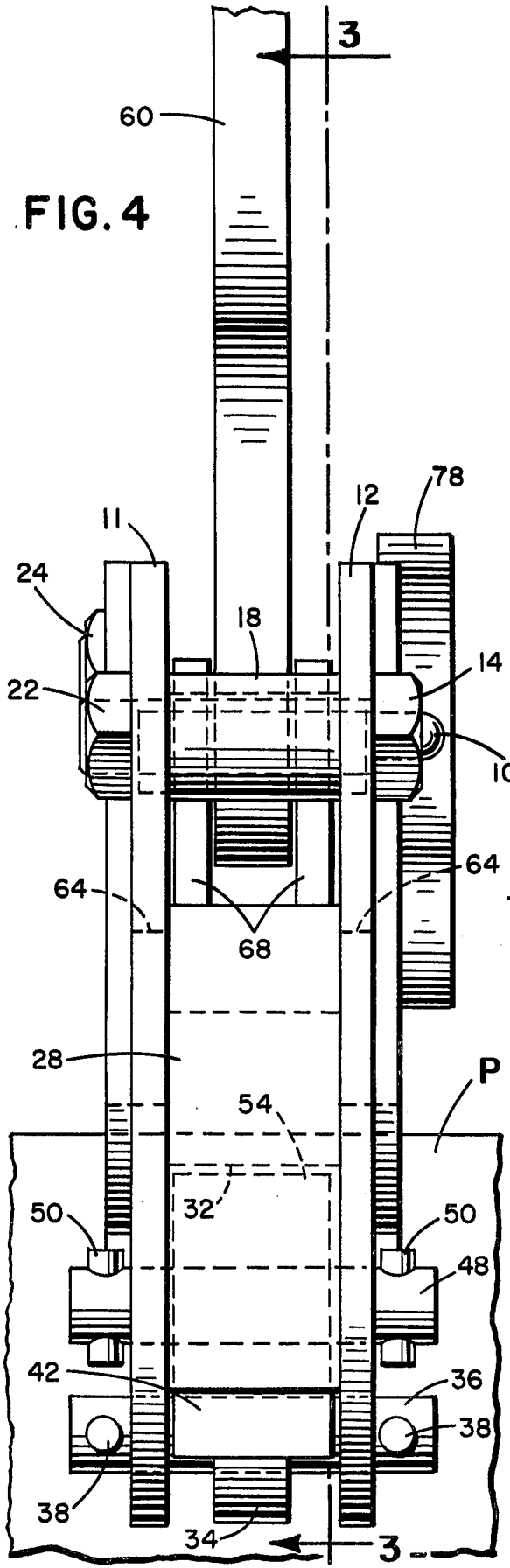
FIG. 4 is a side elevational view of the clamp.
Figure 5:
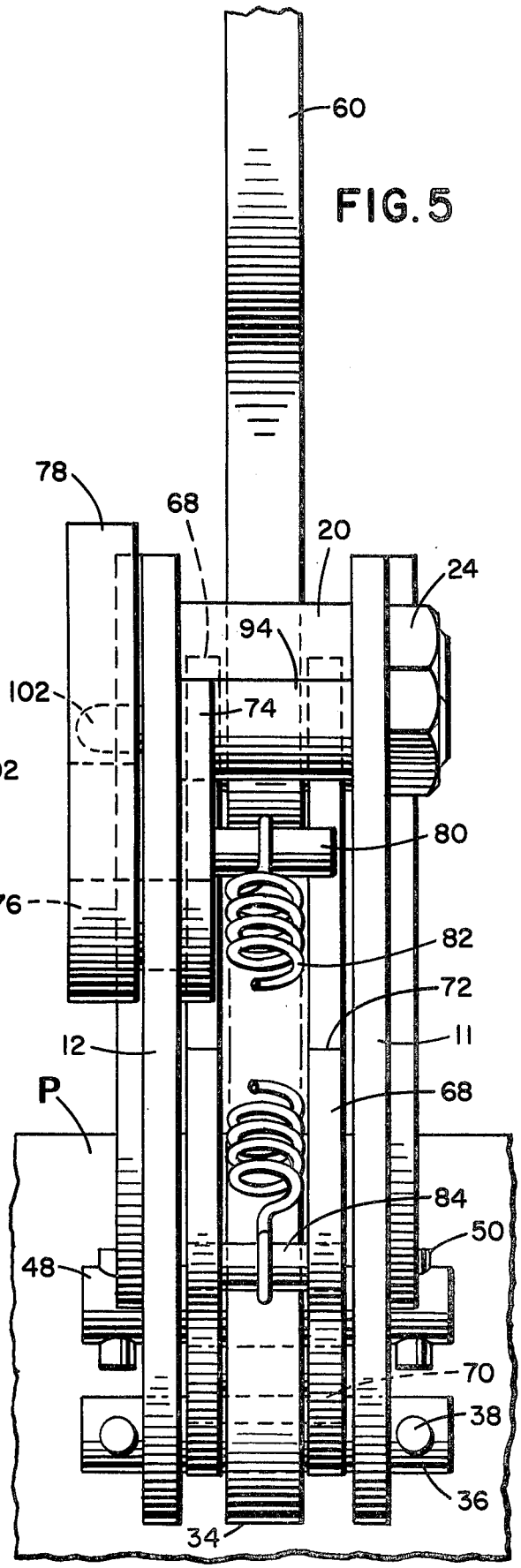
FIG. 5 is a side elevation of the clamp taken from the opposite direction of FIG. 4.
Figure 9:
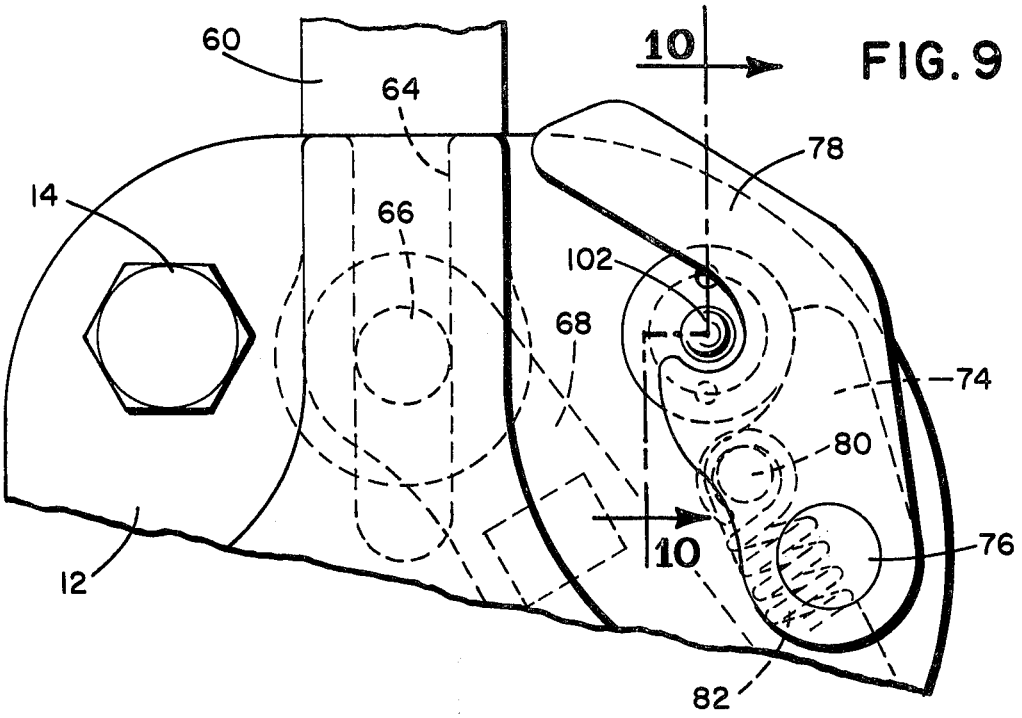
FIG. 9 is a partial elevational view of an alternative embodiment showing the auxiliary lock, latching the handle of the primary locking mechanism.

The clamp 10 has a body made up of two side plates 11 and 12, these are best shown in FIGS. 4 and 5 and in section in FIG. 6. The pair of side plates 11 and 12 are secured in spaced relation to each other by a pair of connecting bolts 14 and 16. Each bolt has a spacer tube 18 and 20, respectively surrounding the bolt and establishing the appropriate spacing between the pair of side plates of the clamp body. These bolts are located near the top of the clamp body as best shown in section in FIG. 3. It will be noted that bolt 14 has a conventional nut 22 threaded thereon to hold the side plates in spaced relation. Nut 14 also has a conventional head as appears in FIGS. 1 and 2. On the other hand the bolt 16 has a conventional nut 24 threaded thereon but as shown in section in FIG. 7, it has a tapered head fitting in a tapered hole in plate 12 for the head of the bolt 16 to be flush with the outer surface of plate 12. This head of bolt 16 is provided with an allen wrench socket 26 to facilitate holding the bolt while nut 24 is being threaded and tightened thereon. This flush mounting of bolt head 16 has a purpose that will be apparent from the subsequent description. As shown in FIG. 3, the side plates 11 and 12 are also secured together by means of a bridging member 28. This bridging member is welded to the inside of plate 11 and inside of plate 12 to firmly hold the lower ends of the clamp side plates in appropriate spaced relation. In addition to the bridging plate 28, a member 30 is also welded to the inside of the plates and provides a stop for the small cam jaw. Again as shown in FIG. 3, the combination of the bridging member 28, the member 30 provide a stop pocket 32 to limit the rotation or movement of the small cam jaw as will be described hereinafter.

A pair of jaws are pivotally mounted between the side plates 11 and 12. Thus movable arcuate gripping jaw 34 is mounted on a pin 36. This pin 36 extends through apertures formed in the side plates 11 and 12 and is held loosely in the side plates of the clamp body by retaining pins 38, as shown in FIGS. 4 and 5.

The jaw 34 has a series of teeth 40 formed on its arcuate gripping surface as shown in FIGS. 1 and 3. These teeth 40 extend transversely across the width of the jaw 34 and in combination with the arcuate configuration of the gripping surface provide an improved grip for the article, such as plate P, being lifted. The arc of the gripping surface carrying teeth 40 is not the arc of a circle but rather has a lesser curvature toward its lower end, as shown in FIG. 1, and a sharper curvature as its nears the upper end of the gripping surface on jaw 34. This has an advantage in that as the jaw moves into gripping engagement with an article, such as plate P, the downward movement tends to drive the teeth 40 more firmly into the surface of the article being lifted.

The other smaller camming jaw 42 is pivotally mounted at the opposite side of the slot 44, the slot 44 being formed in the side plates of the clamp body to receive the article to be lifted. It will be noted that the slot 44 is laterally enlarged at its inner most area as shown at 46, whereas, it has a narrower entrance way adjacent the outer end of the slot 44. This lateral enlargement 46 has an advantage in that it enables a plate being lifted to rock back and forth without engaging the sides of the slot which can have a tendency for the plate or article being lifted to "walk out" of the clamp slot. The characteristic of such swinging movement of an article such as plate P is illustrated in the different positions of the plate shown in FIG. 3 where the solid line position shows one swinging position of the plate and the phantom line showing illustrates the motion of the plate were it to swing in the opposite direction.

Cam jaw 42 mounted on one side of the slot 44 is pivotally supported on pin 48. This pin 48, like pin 36 that supports gripping jaw 34, is mounted in apertures formed in the side plates 11 and 12 of the clamp body and held in this position by retaining pins 50. Like the gripping jaw 34, the smaller cam jaw has teeth 52 formed on the outer arcuate gripping surface of such jaw. The gripping surface carrying teeth 52 on cam jaw 42 is also not an arc of a circle but rather has at its lower outer end a lesser curve, as shown in FIG. 1.

As best shown in FIG. 3, the upper rear portion of cam jaw 42 has a squared end segment 54. This segment fits in the pocket 32 formed between bridging plate 28 and member 30. As shown in FIG. 3, the relation of the squared segment 54 on jaw 42 to the pocket 32 on the clamp body is such that the jaw 42 is restricted to a limited pivotal movement on pin 48, this movement being shown as a maximum of 5 degrees from pivoting in one direction engaging one portion of the pocket 32 to full pivoting in the other direction engaging another portion of the pocket 32.

In practice better holding occurs with the combination of the teeth and the formed gripping surfaces which have in the case of both jaw 34 and jaw 42 a larger radius of curvature near the outer end of the jaw leading into a smaller curvature at the upper end within the laterally enlarged portion 46 of the slot 44. When the clamp is placed in operation to lift an article, the small camming jaw 42 tends to pivot down as the gripping jaw 34 moves into engagement with the opposite side of the article being lifted. With this downward camming the jaw moves to a point where it is slightly tilted and the smaller radius curvature carrying teeth 52 on jaw 42 cams in for a more firm gripping of the surface of the article being lifted.

A shackle 60 having a large opening 62 adapted to receive a conventional lifting hook at the end of a hoisting cable is mounted to extend into the body of the lifting clamp between side plates 11 and 12. This shackle 60 is supported in a pair of grooves 64 formed on the opposite inner sides of the plates 11 and 12. These grooves 64 extend vertically and the shackle carries a pin 66 at its lower end. This pin extends beyond the width of the shackle 60 and engages within the grooves 64, as shown in FIG. 6, to enable upward and downward movement of the shackle 60 in carrying out action to open and close the clamp by pivoting gripping jaw 34 on its mounting pin 36.

The shackle is connected to the gripping jaw 34 by link means formed by a pair of flat link bars 68, which are best shown on FIGS. 4 and 6. These link bars 68 are pivotally engaged with the shackle pin 66, as shown in FIG. 6, and extend downwardly between the side plates of the body within the lifting clamp to be engaged by pin 70 with the end of jaw 34 remote from the pivot pin 36 which holds the jaw pivotally between the side plates 11 and 12. The flat spaced link bars 68 are disposed on opposite sides of the lower end of the shackle within the clamp body defined between side plates 11 and 12. They extend downwardly within the body and by way of their connection to jaw 34 by means of pin 70 they transfer lifting force from the shackle through pin 66. The shackle 60 is movable vertically in the clamp body by the sliding action of shackle pin 66 in the slots 64. The slots limit the nonrotational movement of shackle pin 66 to a vertical path. The shackle at its upper end has the lifting connection formed by the large opening 62 as previously mentioned.

When the clamp is mounted on a plate which is in a horizontal position with the movable jaw on top of the plate, application of lifting force to the opening 62 causes the shackle to pivot and engage the spacing sleeve 20 which serves as a fulcrum thereby causing the shackle to raise the shackle pin 66 in the slots 65 and apply a closing force to the jaw 34 in the manner fully described in U.S. Pat. No. 2,654,630.

To an extent the structure heretofore described is known in the prior art. The unique arcuate configuration of the jaws with differing curvature arcs in different portions and the laterally enlarged configuration of the slot provided by both of the clamp body sideplates 11 and 12 contribute to better gripping as well as safer gripping. With the limited pivotal movement of the cam jaw 42 restricted in its movement by the pocket 32 formed by plate 28 and member 30, improved clamping action is achieved in grasping and firmly holding an article being lifted such as a plate P.

At least one of the flat link bars 68 has a shoulder 72. Protruding pawl 74 is rotatably mounted fixed on a pin 76 within the body of the lifting clamp between plates 11 and 12. The pin 76 has a manually operable handle 78 which is disposed on the outer side of the side plate 12 to be accessable to the lifting clamp operator. When the handle 78 is moved to the position as shown in FIG. 2, the protruding pawl 74 engages the shoulder 72 on one of the flat link bars 68 to hold the principal gripping jaw 34 in the open position, as shown in FIG. 2. In that position there is no closing force on the movable jaw 34 which is permitted to remain fully open and the engagement of the protruding pawl 74 with the shoulder 72 locks the clamp in the open position. If desired, in heavier clamps, a pawl 74 may be mounted on each of the ends of the pin 76 to engage both of the connecting link bars 68.

The pawl 74 also carries a pin 80 which is eccentric to the rotating shaft 76 with which the pawl rotates and to which the handle 78 on the exterior of the clamp body is secured. The pin 80 is engaged by a tension spring 82 which has its other end connected to a pin 84 fastened to the lower end of link bar 68. The pin 84 extends between the two link bars 68 to be engaged by the lower end of spring 82 as best shown in FIG. 5. When the handle 78 on the exterior of the clamp is disposed in the position shown in FIG. 2, the spring 82 is relaxed or not under tension. In this condition the clamp jaws are open and the pawl 74 engaged with the shoulder 72 on the link bars 68 to hold the clamp jaws open.

Spring 82 is tensioned between pin 80 eccentric with the axis of rotating pin 76 and pin 84 fixed to the link bar 68, as shown in FIG. 3. When this action takes place the tensioning of the spring acts to pull the main gripping jaw 34 to a closing position, as shown in FIGS. 1 and 3. In that position the two jaws are brought toward one another and a plate or other article to be lifted, located between the jaws, will be grasped by the two jaws and held. The greater the force added to the shackle 60 acting through the link bars 68 will transmit further force to bring the two jaws together.

The limited pivotal movement of the small camming jaw 42 along with the transverse teeth 40 and 52 on the two jaws, has two advantages which should be noted. First of all as previously mentioned, the force tending to raise the clamp through shackle 60 against the weight of the article or other item such as plate P being lifted, tends to cam both of the jaws 34 and 42 downwardly so that the shorter radius arcs at the upper ends of the jaws will tend to grip in even tighter. As previously mentioned, the lateral enlargement in the slot 44 at 46 also permits the plate to swing and therefore avoid the plate tending to "walk out" of the slot. This, as also previously mentioned, is illustrated in the positions of the plate shown in FIG. 3. A further benefit of having the small camming jaw mounted for limited pivotal movement is that with the rather enlarged teeth on both of the jaws, the clamp could be slammed together in a way that would tend, over at least a period of use, to damage the bitting quality of the teeth on the two jaws. However, with the camming jaw 42 mounted for limited pivotal movement the teeth tend to mesh together and adjust so that they don't come together at the points which might damage the teeth on one or both of the jaws were the clamp to be slammed to a closed position on a frequent basis.

When the handle 78 is rotated to the position shown in FIG. 1, an important feature of the invention is provided by an auxiliary spring biased locking pin to hold the locking mechanism which in turn presses the jaws toward closing position and is actuated by manually manipulated handle 78. It can occur in the lifting operation with an article such as plate P gripped between the teeth of the jaws of the clamp, that in raising the plate with the handle 78 exposed on the outside of the lifting clamp body, this handle can engage and be moved from the clamp closing position, as shown in FIG. 1, to the clamp opening position, as shown in FIG. 2. Although the continued weight of the article between the jaws will most likely retain the jaws in their closed position despite release of the locking mechanism to the position of FIG. 2, there remains the danger of the jaws either moving open or releasing their solid grip with the obvious danger of the article being lifted disengaging from the jaws and the clamp. To avoid this consequence and as an added protection, an auxiliary spring biased locking pin is provided on the clamp body to engage with the handle 78 and retain it positively in the position shown in FIG. 1.

The jaws 42 and 34 while they are shown in a form that have arcuate surfaces carrying the teeth 40 and 52, respectively, it is possible that and to be understood that these jaws might instead be made, one or the other of them, with a more or less spherical or semispherical curvature for gripping an article to be lifted.

It will be noted that the eccentric location of the pin 80 on pawl 74 and the relationship of the pawl, as shown in FIGS. 1 and 2, relative to the spring and its connection at its lower end to pin 84 on the link bar 68 gives an over center spring connection such that the tension of the spring shown in FIGS. 1 and 3 urges the handle 78 toward its locked position where the pawl 74 engages the sleeve member which is described hereinafter. Thus, there is a requirement for some force to move the handle 78 from the position of FIGS. 1 and 3 over the center axis of pin 76 to release it to the open jaw position, shown in FIG. 2.

There are several different embodiments for the construction and location of the spring biased auxiliary locking pin which positively holds the handle 78 in the jaw closing position. Also one embodiment is provided where the pin may be depressed and rotated to engage its detent and hold the pin fully retained in the clamp so that the auxiliary locking means is effectively deactivated.

Figure 10:
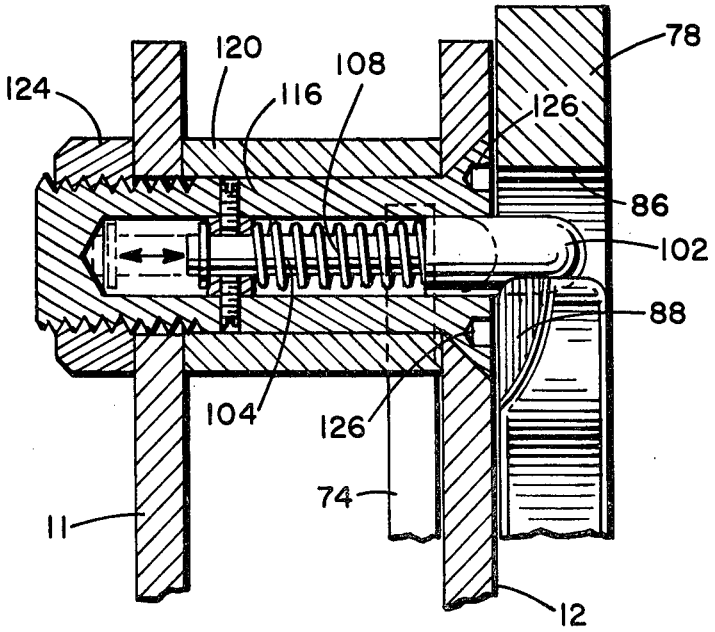
FIG. 10 is a view taken on line 10—10 of FIG. 9.

Turning to the configuration of handle 78 which is mounted on rotating pin 76 that controls the movement of pawl 74 within the body of the lifting clamp, it will be noted that the handle 78 is provided with a notch 86. This provides a pocket in which the auxiliary spring biased locking pin extends to positively lock the handle 78 in the position shown in FIG. 1. In addition to the notch 86, the underside surface of the handle 78 immediately adjacent the notch 86, is provided with an inclined cam surface 88. Cam surface 88 is provided so that in moving the handle 78 to the closed jaw position the cam surface 88 will act to move the locking pin inwardly so that it may then spring outwardly back into the notch 86 to perform the holding function for the pin, as will be described hereinafter. This cam surface 88 is best shown in FIG. 10 of the drawings.

In one embodiment the auxiliary spring biased locking pin is formed and mounted in a separate pocket, provided between the side plates 11 and 12 of the lifting clamp. This particular embodiment is shown in section in FIG. 8 which is taken on line 8—8 of FIG. 2. An alternative embodiment is shown in section in FIG. 10 wherein the auxiliary locking pin is mounted within one of the bolts forming a part in securing the side plates 11 and 12 together as part of the clamp body. A third embodiment is shown in FIG. 11 where the detent for deactivating the auxiliary locking pin is illustrated whereby by pressing the pin inwardly and turning it through an arc of 90 degrees, the pin may be held completely within the clamp body and thus the auxiliary locking pin feature will not be present when it is not desired or needed. In this condition the colored end of the auxiliary locking pin will be displayed in the manner as hereinafter described.

Referring to FIG. 8, a separate sleeve 90 is provided mounted in apertures formed in the side plates 11 and 12 of the clamp. This sleeve 90 is provided with a cover or end cap 92. A spacer tube 94 extends between the inner surfaces of the plates 11 and 12 to dispose them in the desired and appropriate spacial condition. A set screw 96 may be provided to extend through spacer tube 94 and threaded into sleeve 90 to fix the elements in proper position. A ring 98 is mounted within sleeve 90 and held in position by one or more screws 100. A pin 102 carried by a shaft 104 is disposed within sleeve 90 to project outwardly beyond the surface of clamp side plate 12. The outer end of pin 102 is intended to engage within the pocket 86 of manually operable handle 78. Also this outer end of pin 102 is to be cammed inwardly as the handle 78 is rotated, this camming being achieved by the cam surface 88 on the underside of the handle 78. The pin 102 and shaft 104 on which it is carried, are retained against removal or displacement out of the pocket formed by sleeve 90 by a retainer 106. This retainer fits in a groove on the end of shaft 104 and engages with ring 98 to keep the pin 102 from leaving the pocket formed by sleeve 90. A spring 108 acts on the underside of pin 102 and against ring 98 to bias the pin 102 outwardly of the pocket formed by sleeve 90 with retainer 106 preventing the spring from expelling the pin 102 from sleeve 90.

In operation, the movement of handle 78 pivoting about the axis of pin 76 brings the notch 86 into engagement with pin 102. The cam surface 88 on the underside of handle 78 cams the pin inwardly within the sleeve 90 to move it to the phantom position shown in FIG. 8. Then as the handle 78 moves further the pin enters the notch 86 in the handle 78 and the pin under the force of spring 108 is expelled outwardly to move into the notch to securely hold the handle in the latched position. To release the handle it is merely necessary to manually depress the pin 102 back into the pocket formed by sleeve 90 against the urging of spring 108 and thus release the handle where it can be rotated to the position such as shown in FIG. 2.

In the embodiment of FIG. 8, the pin 102, acting as an auxiliary spring baised locking pin for the handle 78, is mounted in its own separate pocket apart from the part and other members used in constructing the clamp. In FIG. 10 a very similar embodiment is illustrated, but in this embodiment one of the bolts such as bolt 16 and spacer 20, as shown in FIG. 7, is constructed to have a pocket for the pin with the pin as an auxiliary locking means mounted within this bolt. Thus, using numbers comparable to those shown in FIG. 7, the bolt 116 and spacer 120 are secured in place by a nut 124, these components acting as mechanical connectors for the upper portion of the side plates of the lifting clamp in the same manner as bolts 16, spacer 20 and nut 24. The head of bolt 116 is tapered to fit in a tapered hole as in the case of bolt 16. The end of the bolt 116, which is flush with the outer surface of plate 12 may have spaced recesses 126. The recesses 126 can simply be engaged by a spanner wrench to hold the bolt during the period that the nut 124 is being tightened up in assembly of the clamp body.

The embodiment of FIG. 11 is quite similar to that of FIG. 10. The locking pin 202 is mounted within a bolt forming a part of the connecting means for the side plates 11 and 12 in the same manner as in FIG. 10. Likewise a spacer is used between the plates and the body bolt is held by a nut at the end thereof. Unlike FIG. 10, the bore forming a pocket for locking pin 202 extends completely through the bolt with an end of the shaft 206 carried by the pin 202 extending into the opposite end of this bore. This shaft 206 within bolt 216 may have an appropriately colored end 204 which will be exposed when the pin 202 is projected entirely within the bolt and the colored end 204 is exposed at the opposite end in the dotted line position, shown in FIG. 11. The shaft 206 on pin 202 carries a detent 208, which is in the form of a pin extending transversely through a bore within shaft 206. In the normal operative position for the locking pin 202 this detent 208 will rest against the ring 210 under the influence of spring 212. A split sleeve 214 engages around the shaft 206 rearwardly and on the opposite sides of the pin 202. The detent 208 may slide between the split halves of sleeve 214 and then the pin 202 rotated to position it in the location shown in Phantom in FIG. 11. To facilitate rotation of the pin 202, it is provided with a screwdriver slot 218 at its outer end whereby to deactivate the auxiliary locking pin a screwdriver may be inserted in the slot, the pin pressed in and then turned through 90 degrees to locate detent 208 in pockets at the ends of the split sleeve 214. In this position the detent 208 will hold the pin 202 within the pocket formed in bolt 216 and the auxiliary locking means will be effectively deactivated or inoperative until the screwdriver slot 218 is again engaged and the pin pressed in and rotated 90 degrees to free the detent 208 for movement back through the and between the halves of sleeve 214 to the position shown in FIG. 11.

If desired, the limited pivotal movement of the smaller cam jaw 42 may be omitted although there are advantages with the limited pivotal movement for this jaw 42, as previously described.

There have been illustrated and described what are considered to be preferred embodiments of the invention. It will be understood however, that various modifications may be made by persons skilled in the art without departing from the scope of the invention which is defined solely by the appended claims.

I claim:

1. A lifting clamp for articles such as steel plates comprising:

a clamp body including a pair of spaced side plates, said body defining a slot through said side plates to receive an article to be lifted, said slot being laterally enlarged inwardly of its open outer end, a pair of opposed jaws mounted on pivot pins connected to said body on opposite sides of said slot adjacent said open end of said slot with said jaws having convex gripping surfaces facing inwardly from the opposite sides of said slot, each of said pivot pins being perpendicular to said side plates, one of said jaws being a gripping jaw pivotally mounted for opening and closing movement relative to the other jaw and the other jaw being a cam jaw, a shackle mounted for guided movement in said clamp body and adapted for connection to a lifting force, link means connecting said shackle to said gripping jaw to close said gripping jaw when a lifting force is applied to said shackle, said link means and said gripping jaw forming an assembly, locking means having a manually operated handle pivotally mounted outside of said clamp body and a spring between said side plates connected to said assembly, said spring being tensioned by rotation of said handle to urge said gripping jaw toward its closing position and released by reverse rotation of said handle to free said gripping jaw to move to its open position, said cam jaw being unconnected to said shackle and mounted for free pivotal movement about its pivot pin with its convex gripping surface extending eccentrically above its pivot pin to be cammed inwardly in the slot into closer gripping relation with said gripping jaw in response to a downward load on said convex gripping surfaces, and said clamp body extending laterally outwardly from said slot past said cam jaw to completely enclose the outer surface of said cam jaw opposite its gripping surface and said clamp body being relieved to enlarge the side of said slot above the pivot pin for said cam jaw so that the upper end of a plate engaged between said jaws can pivot around said cam jaw while maintaining gripping contact with the convex gripping surface of said cam jaw and without engaging said side of the slot.

2. A lifting clamp as recited in claim 1 wherein an auxiliary lock means is mounted on the clamp body to be engagable with said handle to latch said handle against inadvertent movement from its position urging said gripping jaw to closing position.

3. A lifting clamp as recited in claim 2 wherein said auxiliary lock means is spring biased to be manually releasable to free the handle for reverse rotation.

4. A lifting clamp as recited in claim 2 wherein said auxiliary lock means is shiftable to a position where it is deactivated from latching said handle.

5. A lifting clamp as recited in claim 2 wherein said auxiliary lock means comprises a pin reciprocally mounted in a pocket within the clamp body, said pin being spring biased to extend outwardly of the body for engagement with said handle in latching said handle.

6. A lifting clamp as recited in claim 5 wherein said pin is mounted in a separate pocket provided between said side plates.

7. A lifting clamp as recited in claim 5 wherein said clamp body side plates have bolts extending therebetween on opposite sides of said shack and said pocket for said pin is formed within one of said bolts.

8. A lifting clamp as recited in claim 5 wherein said pin has a latching detent engagable with a shoulder in said pocket by depressing and rotating said pin to hold said pin fully within said pocket to deactivate said pin from latching said handle.

9. A lifting clamp as recited in claim 5 wherein said handle has an inclined cam surface on the handle portion which initially engages said pin to cam the pin into said pocket as the handle is moved to its full jaw closing position and said handle has a notch into which said pin extends when the handle is in its full jaw closing position.

10. A lifting clamp as recited in claim 1 wherein said cam jaw is mounted on said clamp body for limited pivotal movement.

11. A lifting clamp as recited in claim 10 wherein both of said jaws have gripping teeth extending transversely of the jaw surface which is to grip the article to be lifted.

12. A lifting clamp as recited in claim 10 wherein the gripping surface on each jaw is curved at a smaller arc on the portion located furthermost inwardly of said slot through said side plates.

13. A lifting clamp for articles such as steel plates:

a clamp body including a pair of spaced side plates, said body defining a slot through said side plates to receive an article to be lifted, a pair of opposed jaws mounted on opposite sides of said slot, one of said jaws being a gripping jaw pivotally mounted for opening and closing movement relative to the other jaw, a shackle mounted for guided movement in said clamp body and adapted for connection to a lifting force, link means connecting said shackle to said gripping jaw to close said gripping jaw when a lifting force is applied to said shackle, said link means and said gripping jaw forming an assembly, primary locking means having a manually operated handle pivotally mounted outside of said clamp body and a spring between said side plates connected to said assembly, said spring being tensioned by rotation of said handle to urge said gripping jaw toward its closing position and the tension released by reverse rotation of said handle to free said gripping jaw to move to its open position, and auxiliary lock means mounted on the clamp body to be engagable with said handle to latch said handle against inadvertent movement from its position urging said gripping jaw toward closing position.

14. A lifting clamp as recited in claim 13 wherein said auxiliary lock means is spring biased to be manually releasible to free the handle for reverse rotation.

15. A lifting clamp as recited in claim 13 wherein said auxiliary lock means is shiftable to a position where it is deactivated from latching said handle.

16. A lifting clamp as recited in claim 13 wherein said auxiliary lock means comprises a pin reciprocally mounted in a pocket within the clamp body, said pin being spring biased to extend outwardly of the body for engagement with said handle in latching said handle.

17. A lifting clamp as recited in claim 16 wherein said pin is mounted in a separate pocket provided between said side plates.

18. A lifting clamp as recited in claim 16 wherein said clamp body side plates have bolts extending therebetween on opposite sides of said shackle, and said pocket for said pin is formed within one of the bolts connecting said side plates together to form the clamp body.

19. A lifting clamp as recited in claim 16 wherein said pin has a latching detent engagable with a shoulder in said pocket by depressing and rotating said pin to hold said pin fully within said pocket to deactivate said pin from latching said handle.

20. A lifting clamp as recited in claim 16 wherein said handle has an inclined cam surface on the handle portion which initially engages said pin to cam the pin into said pocket as the handle is moved to its full jaw closing position and said handle has a notch into which said pin extends when the handle is in its full jaw closing position.

* * * * *